US007529345B2

(12) United States Patent
Bard et al.

(10) Patent No.: US 7,529,345 B2
(45) Date of Patent: May 5, 2009

(54) CATHODE HEADER OPTIC FOR X-RAY TUBE

(75) Inventors: Erik C. Bard, Orem, UT (US); Steven D. Liddiard, Springville, UT (US); Charles R. Jensen, American Fork, UT (US)

(73) Assignee: Moxtek, Inc., Orem, UT (US)

( * ) Notice: Subject to any disclaimer, the term of this patent is extended or adjusted under 35 U.S.C. 154(b) by 0 days.

(21) Appl. No.: 11/879,970

(22) Filed: Jul. 18, 2007

(65) Prior Publication Data

US 2009/0022277 A1 Jan. 22, 2009

(51) Int. Cl.
*H01J 35/06* (2006.01)

(52) U.S. Cl. ..... 378/136; 378/122

(58) Field of Classification Search ..... 378/119, 378/121, 122, 136; 313/446–451
See application file for complete search history.

(56) References Cited

U.S. PATENT DOCUMENTS

| | | | |
|---|---|---|---|
| 2,291,948 | A | 8/1942 | Cassen |
| 2,316,214 | A | 4/1943 | Atlee et al. |
| 2,329,318 | A | 9/1943 | Atlee et al. |
| 2,683,223 | A | 7/1954 | Hosemann |
| 2,952,790 | A | 9/1960 | Steen |
| 3,679,927 | A | 7/1972 | Kirkendall |
| 3,828,190 | A | 8/1974 | Dahlin et al. |
| 4,160,311 | A | 7/1979 | Ronde et al. |
| 4,184,097 | A | 1/1980 | Auge |
| 4,521,902 | A | 6/1985 | Peugeot |
| 4,679,219 | A | 7/1987 | Ozaki |
| 4,777,642 | A | 10/1988 | Ono |
| 4,797,907 | A | 1/1989 | Anderton |
| 4,979,198 | A | 12/1990 | Malcolm et al. |
| 5,010,562 | A | 4/1991 | Hernandez et al. |
| 5,066,300 | A | 11/1991 | Isaacson et al. |
| 5,077,771 | A | 12/1991 | Skillicorn et al. |
| 5,077,777 | A | 12/1991 | Daly |
| 5,105,456 | A | 4/1992 | Rand et al. |
| 5,117,829 | A | 6/1992 | Miller et al. |
| 5,153,900 | A | 10/1992 | Nomikos et al. |
| 5,161,179 | A | 11/1992 | Suzuki et al. |
| RE34,421 | E | 10/1993 | Parker et al. |
| 5,267,294 | A | 11/1993 | Kuroda et al. |
| 5,391,958 | A | 2/1995 | Kelly |
| 5,400,385 | A | 3/1995 | Blake et al. |

(Continued)

FOREIGN PATENT DOCUMENTS

| | | |
|---|---|---|
| GB | 1252290 | 11/1971 |

OTHER PUBLICATIONS

Sheather, Journal Phys. E., Apr. 1973, pp. 319-322, vol. 6, No. 4.

*Primary Examiner*—Jurie Yun
(74) *Attorney, Agent, or Firm*—Thorpe North & Western, LLP

(57) ABSTRACT

A cathode header optic for an x-ray tube includes an elongate trench with opposite trench walls. A cup recess is formed in the trench between the opposite trench walls, and has a bounded perimeter. A cathode element is disposed in the trench at the cup recess. The cathode element is capable of heating and releasing electrons. A secondary cathode optic defining a cathode ring can be disposed about the header optic. The cathode optics can form part of an x-ray tube.

28 Claims, 8 Drawing Sheets

U.S. PATENT DOCUMENTS 5,428,658 A 6/1995 Oettinger et al.
5,469,429 A 11/1995 Yamazaki et al.
5,469,490 A 11/1995 Golden et al.
5,478,266 A 12/1995 Kelly
RE35,383 E 11/1996 Miller et al.
5,621,780 A 4/1997 Smith et al.
5,631,943 A 5/1997 Miles
5,682,412 A 10/1997 Skillicorn et al.
5,729,583 A 3/1998 Tang et al.
5,907,595 A * 5/1999 Sommerer ..... 378/136
6,005,918 A 12/1999 Harris et al.
6,044,130 A 3/2000 Inazura et al.
6,075,839 A 6/2000 Treseder
6,134,300 A 10/2000 Trebes et al.
6,205,200 B1 3/2001 Boyer et al.
6,282,263 B1 8/2001 Arndt et al.
6,351,520 B1 2/2002 Inazaru
6,477,235 B2 11/2002 Chornenky et al.
6,487,272 B1 11/2002 Kutsuzawa
6,487,273 B1 11/2002 Takenaka et al.
6,546,077 B2 4/2003 Chornenky et al.
6,661,876 B2 12/2003 Turner et al.
6,816,573 B2 11/2004 Hirano et al.
6,976,953 B1 12/2005 Pelc
6,987,835 B2 1/2006 Lovoi
7,035,379 B2 4/2006 Turner et al.
7,085,354 B2 8/2006 Kanagami
7,130,380 B2 10/2006 Lovoi et al.
7,130,381 B2 10/2006 Lovoi et al.
7,224,769 B2 5/2007 Turner
7,286,642 B2 10/2007 Ishikawa et al.
2005/0018817 A1 1/2005 Oettinger et al.
2005/0141669 A1 6/2005 Shimono et al.
2006/0098778 A1 5/2006 Oettinger et al.
2007/0183576 A1* 8/2007 Burke et al. ..... 378/136

* cited by examiner

CATHODE HEADER OPTIC FOR X-RAY TUBE

BACKGROUND

1. Field of the Invention

The present invention relates generally to x-ray tubes and more particularly to cathodes or cathode optics for such x-ray tubes.

2. Related Art

Thermionic emission is a very common strategy for obtaining electrons for use in x-ray producing devices. For thermionic electron emission to take place, a source material is heated to high temperature in an evacuated environment in order to impart sufficient energy to bound electrons within the material to liberate them. The energy required is known as the material "work function." A thermionic electron source is usually made of tungsten in the form of a filament and is often alloyed with other material(s) to reduce work function and/or to improve mechanical properties of the filament under the rigors of high-temperature operation.

A critical aspect of any x-ray device containing a thermionic (or other) electron source is the performance of its electron optics. In a miniature x-ray device, an electric or magnetic field is commonly used to focus the emitted electrons into a beam, directed toward an anode target. The beam of emitted electrons is thereby focused to a desired cross-section at a point in space on or near an anode target, where x-rays are produced upon electron impact.

Cathode optics that produce a beam cross section, or "spot size," substantially less than the size of the emitter itself are relatively difficult to design and manufacture for use in an inexpensive, miniature x-ray tube. Miniature x-ray tubes impose unique constraints on the optics that do not necessarily exist in the context of their larger counterparts. These constraints include size, energy efficiency, cost and complexity of manufacture and maintenance of tight manufacturing tolerances applied to very small dimensions.

It is challenging to manufacture a miniature x-ray tube that consistently produces a spot size substantially smaller than the emitter. Originating in the filament itself, small variations in filament shape, size and position are problematic, to the extent that they produce relatively large and objectionable changes in the shape, size and position of the electron beam at its intersection with the anode target. The objectionable observable effect to the end-user application is a corresponding variation in the shape, size, position and intensity of the x-ray emissions from the miniature x-ray device.

A common beam-shaping cathode optic used in conjunction with helical tungsten filament emitter is a "T-slot." The T-slot is well known in the art of x-ray tube optic design. It is, however, difficult to create a T-slot optic of the dimensions appropriate for a miniature x-ray device, wherein the filament coil can be substantially smaller than 1 mm in length. As the dimensions of the filament are smaller in a miniature x-ray device than in a larger-scale device, so also must the dimensions of the electron optics in the vicinity of the filament. A typical t-slot on such a scale is difficult to produce. Even when such a device is created, it is difficult to maintain dimensional tolerances, given the aforementioned variation in filament position and shape within the confines of the optic.

A suitable optic is required for meeting the requirements of manufacturability, tolerance, cost and performance in such respects as electron efficiency, spot size and position.

SUMMARY OF THE INVENTION

It has been recognized that it would be advantageous to develop a thermionic x-ray tube that is less affected by small dimensional changes at the filament. It has been recognized that it would be advantageous to develop an x-ray tube capable of producing a reduced electron beam cross-section. In addition, it has been recognized that it would be advantageous to develop an x-ray tube with increased electron efficiency. In addition, it has been recognized that it would be advantageous to develop an x-ray tube with improved manufacturing tolerances. In addition, it has been recognized that it would be advantageous to develop an x-ray tube with higher x-ray flux for a given operating current. In addition, it has been recognized that it would be advantageous to develop an x-ray tube with improved assembly. In addition, it has been recognized that it would be advantageous to develop an x-ray tube with improved spot size. In addition, it has been recognized that it would be advantageous to develop an improved field-shaping electron optic for use in a cathode assembly of a miniature x-ray tube which is energy efficient, robust, easily manufactured, and that has a focused spot size diameter smaller than 200 microns. Furthermore, it has been recognized that it would be advantages to develop an x-ray tube with one filament connection to the filament platform.

The invention provides a cathode header optic device for an x-ray tube including an elongate trench with opposite trench walls. A cup recess is formed in the trench between the opposite trench walls, and has a bounded perimeter. A cathode element is disposed in the trench at the cup recess. The cathode element is capable of heating and releasing electrons.

In accordance with a more detailed aspect of the present invention, the cathode header optic forms part of an x-ray tube or source with an evacuated dielectric tube. An anode is disposed at an end of the tube and includes a material configured to produce x-rays in response to impact of electrons. A cathode is disposed at an opposite end of the tube opposing the anode, and includes a cathode element configured to produce electrons accelerated towards the anode in response to an electric field between the anode and the cathode.

In accordance with another more detailed aspect of the present invention, a secondary cathode optic or cathode ring can be disposed adjacent and in front of the cup recess and can have a well or bore extending to the trench to further focus the beam.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

Figure 4A:
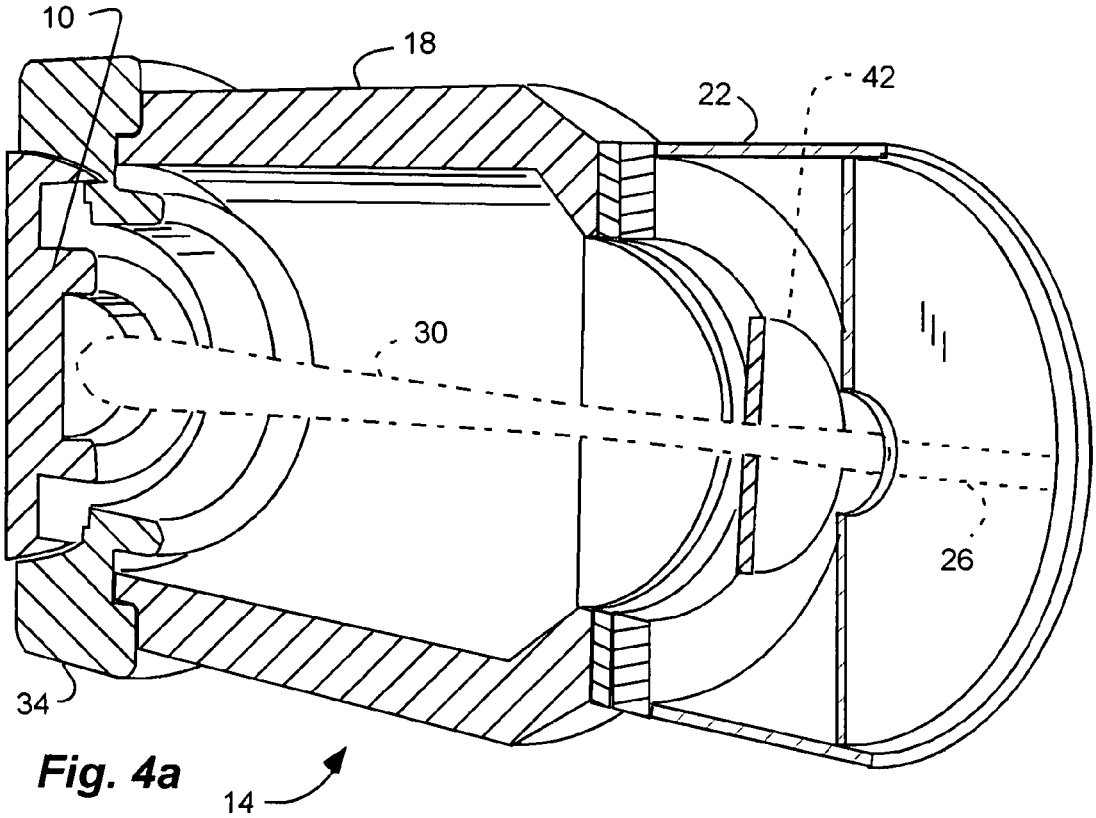
FIG. 4*a* is a partial cross-sectional view of an x-ray tube in accordance with an embodiment of the present invention with a cathode header optic similar to FIG. 1*a;*

Referring to FIGS. 1*a*-2*b*, an exemplary embodiment of a cathode header optic 10 is shown for an x-ray tube or source 14 (FIG. 4*a*). The term cathode header optic is used broadly herein to describe the structure carrying the cathode element and which shapes an electric field which shapes an electron beam emitted from the cathode element. The cathode header optic can form a portion of the cathode of the x-ray tube.

Referring to FIG. 4*a*, the x-ray tube or source 14 can include an evacuated dielectric tube 18. An anode 22 is disposed at an end of the tube and includes a material configured to produce x-rays (represented by lines 26) in response to impact of electrons (represented by lines 30). A cathode 34 is disposed at an opposite end of the tube opposing the anode. The cathode 34 includes a cathode element 38 (FIG. 1*a*) configured to produce electrons accelerated towards the anode in response to an electric field between the anode and the cathode. The cathode element 38 can be a coil, as shown, or can be flat or planar.

The x-ray tube or source 14 can be a transmission-type x-ray source, and the tube 18 can be a transmission type x-ray tube, as shown. The tube 18 can be an elongated cylinder, and in one aspect is formed of a ceramic material, such as aluminum oxide. Ceramic is believed to be superior to the traditionally used glass because of its dimensional stability and its ability to withstand higher voltages. To remove embedded gas, the ceramic is pre-treated by vacuum heating. The anode and the cathode, or portions or extensions thereof, can be formed of a metal material and can be attached at opposite ends of the tube by brazing.

The anode and cathode can form part of the tube, and can be disposed at opposite sides of the tube opposing one another. An electric field is applied between the anode and cathode. The anode can be grounded while the cathode can have a voltage applied thereto. The cathode can be held at a negative high voltage relative to the anode. Alternatively, the anode can be held at a positive high voltage, while the cathode is grounded.

The cathode can be a low power consumption cathode and the cathode element 38 can be a low-mass, low-power consumption cathode element or filament. The cathode element 38 can be a thermionic emitter, such as a miniature coiled tungsten filament. The cathode element 38 produces electrons (indicated at 30 in FIG. 4A) that are accelerated towards the anode in response to the electric field between the anode and the cathode. The cathode element can have a low power consumption, and in one aspect has a power consumption less than approximately 1 watt. The lower power consumption of the cathode element allows the x-ray source to be battery powered, and thus mobile. In addition, the cathode element can have a low-mass, and in one aspect has a mass less than approximately 100 micrograms.

A potential of approximately 1 volt across the filament drives a current of about 200 mA, which raises the temperature to about 2300 C. This temperature is cool compared to most thermionic sources, but it provides sufficient electron emission for the intended applications of the x-ray tube. For example, only 20 μA are required to generate sufficient fluorescence from an alloy to saturate a semiconductor detector. Even higher emission efficiency is obtained if the tungsten cathode is coated with mixed oxides of alkaline earths (e.g. Cs, Ca, or Ba). They do, however, allow operation at temperatures as low as 1000 K. Such coated cathodes can still have a low mass as described above.

There are numerous advantages to this cool, coiled tungsten emitter compared to the conventional hot hairpin type. The cooler wire does not add as much heat, and this eliminates the need for an inconvenient cooling mechanism. The lower temperature reduces tungsten evaporation, so tungsten is not deposited on the anode, and the wire does not become thin and break. The cool tungsten coil, however, does not fall below the Langmuir limit, so space charge can accumulate between it and the Wehnelt optic or cathode optic, described below.

The anode 22 can include a window support structure with a bore through which electrons can pass. A window or target 42 can be disposed at the anode to produce x-rays (indicated at 26) in response to impact of electrons 30. The window or target can include an x-ray generating material, such as silver. The window or target can be a sheet or layer of material disposed on the end of the anode, such as a 2-μm -thick silver. When electrons from the cathode impact the window or target characteristic silver x-ray emission is largely of the same wavelengths as the popular $^{109}$Cd radioactive x-ray sources.

A filter can be used to remove low-energy Bremsstrahlung radiation. The filter can be disposed at the anode on the target material. The filter can include a filter material, such as beryllium. In addition, the filter can be a thin layer or sheet, such as 130 μm of beryllium. The filter or material thereof can coat the window or target. With such a configuration, silver L lines may be emitted, but they are absorbed after traveling a very short distance in air. It will be appreciated that additional filtering can be added after or instead of the beryllium. For example, one could use a balanced filter of the type described by U. W. Arndt and B. T. M. Willis in *Single Crystal Diffractometry*, Cambridge University Press, New York, 1966, p. 301.

The various components described above, such as the cylinder, the cathode, the anode, and the window or target form the evacuated tube. A shield can be disposed around the tube to provide electrical shielding and shielding from stray x-rays. The shield can be electrically coupled to the anode to provide a ground for the anode. In addition, the shield can be metallic to be conductive and shield x-rays. The shield can be a tubular or frusto-conical shell to allow insulation between the x-ray tube and the shield while contacting the anode. A space between the shield and the tube can be potted with a potting compound, such as silicone rubber. In one aspect, the potting material has high thermal conductivity and can include high thermal conductivity materials, such as boron nitride.

The x-ray source also can include a battery operated, high voltage power supply or battery power source electrically coupled to the anode, the cathode, and the cathode element. The battery power source provides power for the cathode element, and the electric field between the anode and the cathode. The battery power source and the low-power consumption cathode element advantageously allow the x-ray source to be mobile for field applications. In addition, the x-ray tube or bulb can have a length less than approximately 3 inches, and a diameter or width less than approximately 1 inch, to facilitate mobility and use in field applications. "Field applications," such as X-ray fluorescence (XRF) of soil, water, metals, ores, well bores, etc., as well as diffraction and plating thickness measurements, are fields that can benefit from such an x-ray source.

Various aspects of x-ray tubes or sources are described in U.S. Pat. Nos. 6,661,876 and 7,035,379; and U.S. patent application Ser. No. 11/540,133; which are herein incorporated by reference.

Figure 3A:
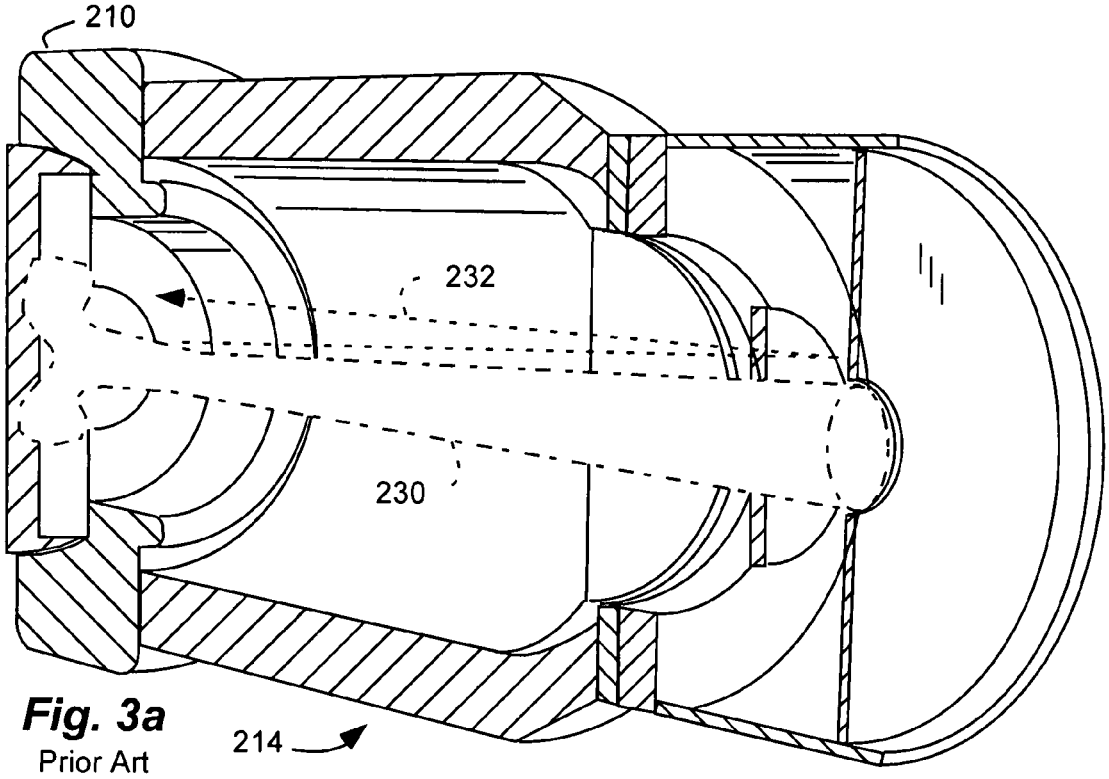
Fig. 3a Prior Art
FIG. 3*a* is a partial cross-sectional view of a prior x-ray tube.
Figure 3B:
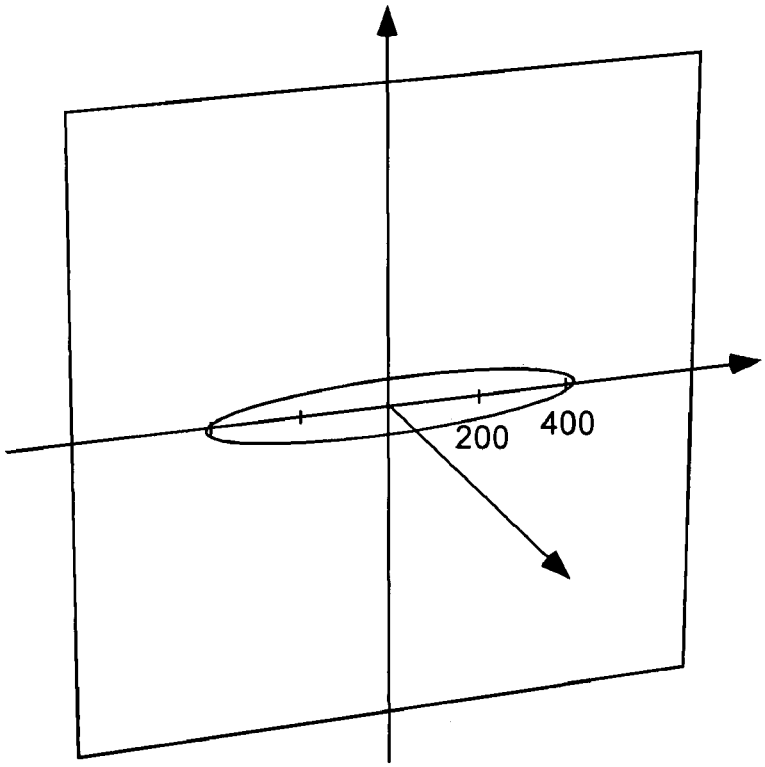
FIG. 3*b* is a representation of the spot geometry produced by the x-ray tube of FIG. 3*a;*
Figure 3C:
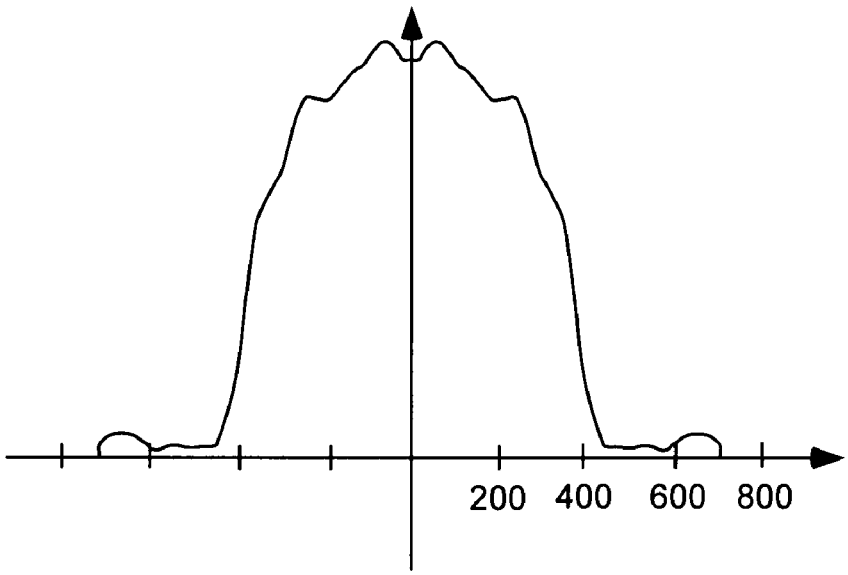
FIG. 3*c* is a power distribution graph of the beam produced by the x-ray tube of FIG. 3*a;*

Referring to FIG. 3*a*, a prior x-ray tube 214 is shown with a prior so-called T-slot cathode optic or header 210 in which the cathode element is suspended above a deep, elongated trench. The resulting spot geometry of the x-ray beam is elongated, as shown in FIG. 3*b*. In addition, the power distribution of the x-ray beam is spread out, as shown in FIG. 3*c*. The wide or divergent x-ray beam can result in electrons striking other portions of the anode and reflecting back to the cathode or cathode element, indicated by line 232. Because the cathode element can be a low power consumption element, it can have a low mass. Thus, the reflected electrons, or sputter-erosion from the positive ions, can significantly damage the cathode element, and detrimentally affect the life of the cathode element. As described above, it is difficult to design and manufacture x-ray tubes with spot sizes below 200 microns. Electric field shaping and focusing tolerances become increasingly complex as the tube size and spot size are reduced.

Referring again to FIGS. 1*a*-2*b*, the cathode header optic 10 can be configured to produce a small spot size or reduced electron beam cross-section that is 1 to 10 times smaller than cathode element or filament. The cathode element can have length of 600 to 700 microns. In one aspect, the spot size can be less than 700 microns. In another aspect, the spot size can be less than 350 microns. In another aspect, the spot size can be less than 200 microns. In addition, the cathode header optic 10 can resist small dimensional changes at the filament, such as due to thermal deformation.

The cathode header optic 10 can form part of the cathode 34. In addition, the cathode 34 can include a secondary cathode optic 48 with a bore or well 50 defined by a perimeter wall 54. The cathode header optic 10 can have a surface 58 that forms a bottom wall of the well 50. The perimeter wall 54 can be circular or cylindrical and the surface 58 can be substantially flat or planar. An elongate trench 62 is formed in the surface 58 at the bottom of the well 50. The trench 62 can be shallow and substantially rectangular, with a width greater than the depth. The trench can have a rectangular cross-sectional shape formed by side walls 63 and a bottom wall 65. The side walls can be parallel and straight while the bottom wall 65 can be flat and perpendicular to the side walls. In addition, the trench 62 can span the well from one side of the perimeter wall to the other. Thus, the trench can be centered in the well. Alternatively, the trench can be shorter, without spanning the well.

A cup recess 66 is formed in the trench 62 between the trench walls 63. The cup recess 66 has a bounded perimeter, and does not have open ends like the trench. The cup recess can have a width less than a length of the trench. The cup recess 66 can be contained within the trench 62, or can be smaller than the trench, with a large dimension of the opening of the cup recess, such as the width or diameter, smaller than a large dimension of the opening of the trench, such as the length. The cup recess 66 can be cylindrical with a diameter substantially equal to the width of the trench. In addition, the cup recess can be centered in the well, and in the trench, so that the well and cup recess are substantially coaxial. The cathode element 38 is disposed in the trench 62 at the cup recess 66. An opening 70 of the cup recess 66 can be formed in the bottom of the trench and the cathode can be disposed in the opening. Thus, the cathode element is disposed between a bottom wall of the cup recess and the top of the trench. The above described geometry of the trench and cup recess has been found to produce a spot size or reduced electron beam cross-section less than a size of the cathode element.

The cathode header optic can be configured to simplify manufacture and increase robustness by limiting openings to the evacuated tube. A single lead bore 74 can extend through the header optic adjacent the cup recess 66. A lead pin 78 can extend through the lead bore 74. The lead pin 78 can be electrically coupled to the cathode element 38, while the opposite end of the cathode element is directly electrically coupled to the header optic. Thus, the electrical connection forms a single bore, rather than two. A passage 82 can be formed between the cup recess 66 and the lead bore 74 overlapping. The lead pin 78 can be disposed adjacent the passage and can substantially span the passage to improve the electric field and resist stray electrons. An insulator 88 (FIG. 2*b*) can be disposed between the lead pin 78 and the header optic.

Figure 4B:
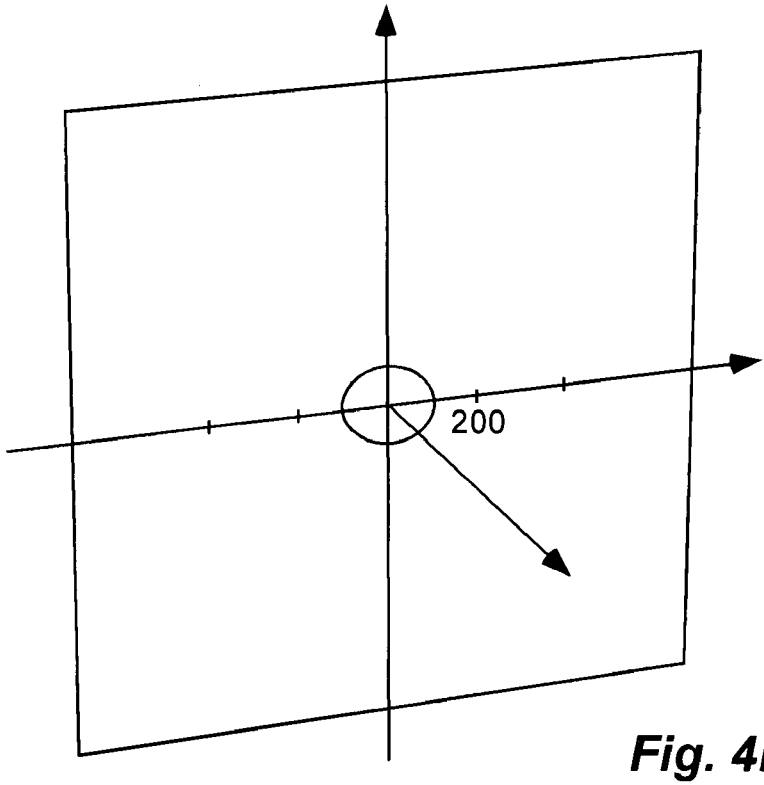
FIG. 4*b* is a representation of the spot geometry produced by the x-ray tube of FIG. 4*a;*
Figure 4C:
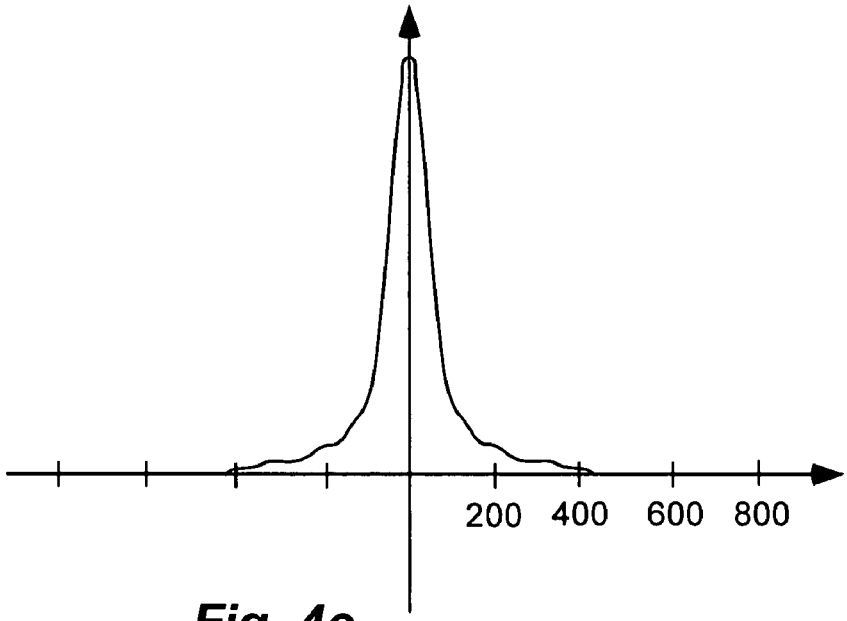
FIG. 4*c* is a power distribution graph of the beam produced by the x-ray tube of FIG. 4*a;*

The trench and the cup recess form an electron optic that shape an electric field and the electron beam. The trench and cup recess produce a spot size or reduced electron beam cross-section less than a size of the cathode element. Referring to FIG. 4*b*, the spot size of the electron beam is reduced due to the configuration of the cathode header optic. In addition, referring to FIG. 4*c*, the power distribution of the x-ray beam is narrowed.

In addition, the cathode header optic 10 and the secondary cathode optic 48 together form a compound beam-forming system within the miniature x-ray device. The header optic 10 can be positioned coaxial with and placed within the second cathode optic 48. The header optic 10 can be partially electrically shielded by the second optical element 48. The presence of a second cathode optic 48 can reduce the normally-high electric field strength in the vicinity of the header optic 10. The reduction of electric field strength can reduce or eliminate the need for polishing the header optic 10 or for other surface finish treatment that is normally used to prevent unintended field emission of electrons or to prevent electric arcing between the header optic and the anode of the x-ray device. The presence of the secondary optic 48 in conjunction with the primary header optic 10 enables additional beam formation and focusing. The secondary optic 48 can be brazed or otherwise joined to the dielectric tube 18 and can also serve the mechanical role of joining the header optic 10 to the miniature x-ray device through soldering, welding or other means.

Figure 1A:
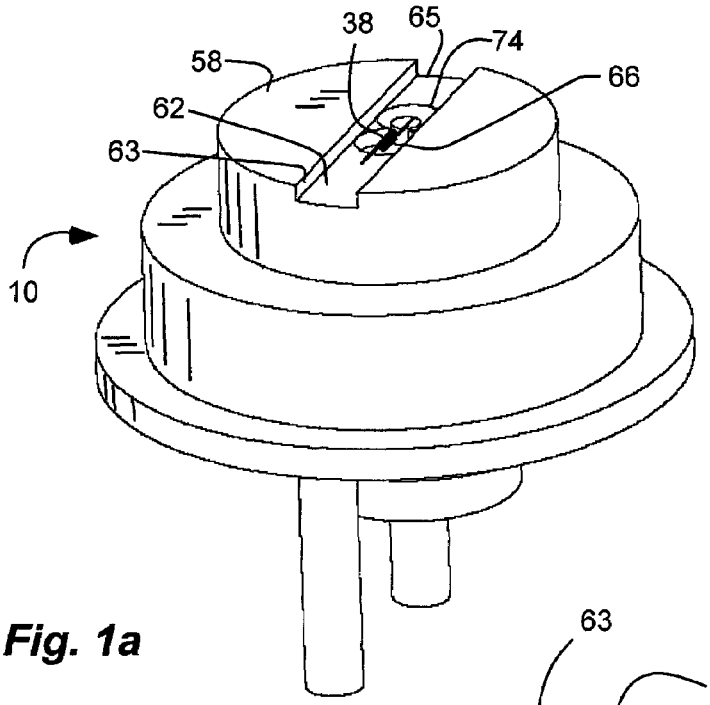
FIG. 1*a* is a perspective view of a cathode header optic in accordance with an embodiment of the present invention.
Figure 2A:
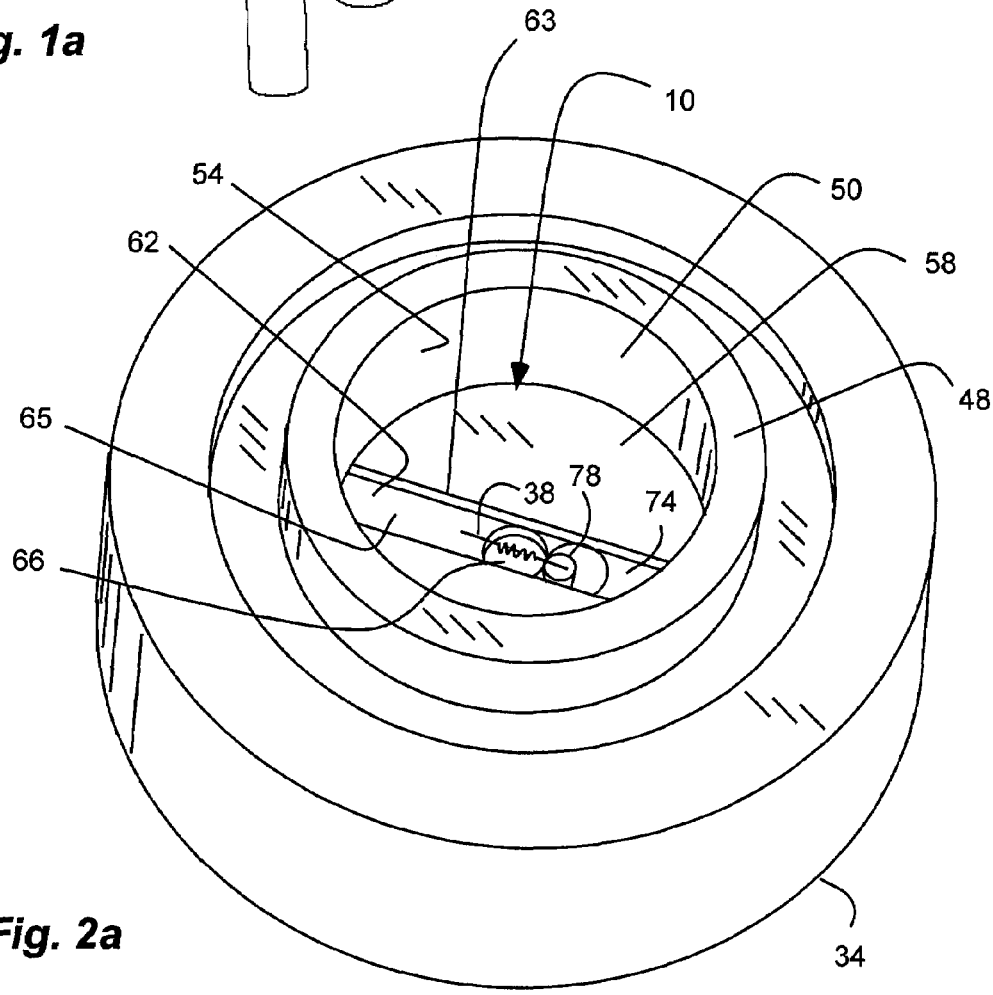
FIG. 2*a* is a perspective view of the cathode header optic of FIG. 1*a* shown with a cathode ring or secondary cathode optic.
Figure 1B:
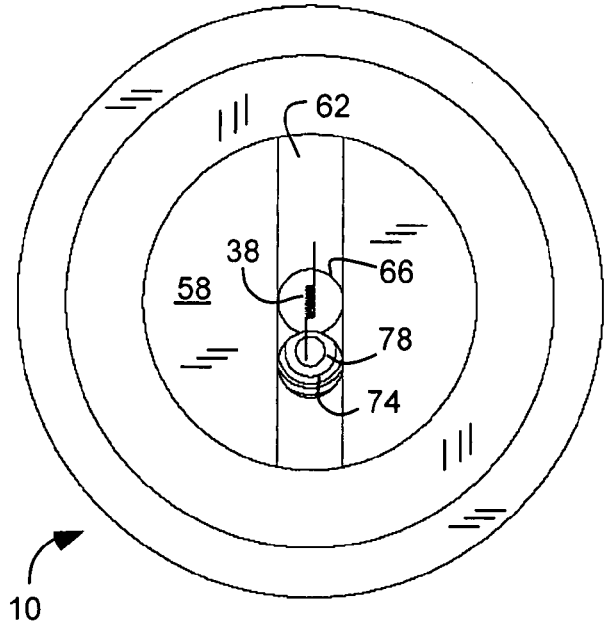
FIG. 1*b* is a top view of the cathode header optic of FIG. 1*a;*
Figure 1C:
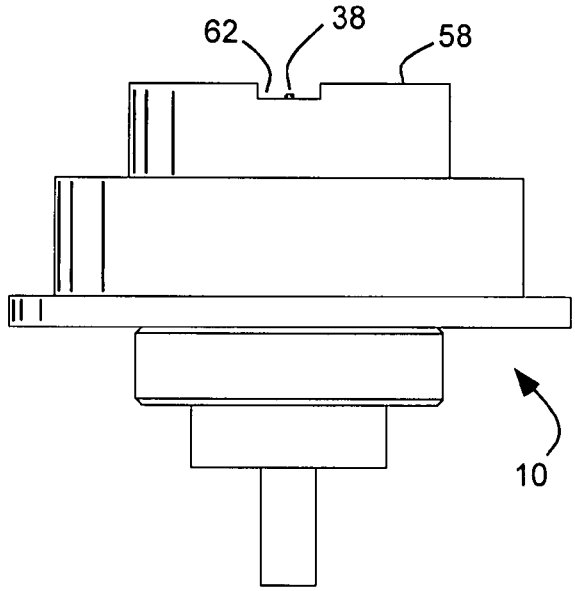
FIG. 1*c* is a side view of the cathode header optic of FIG. 1*a;*
Figure 1D:
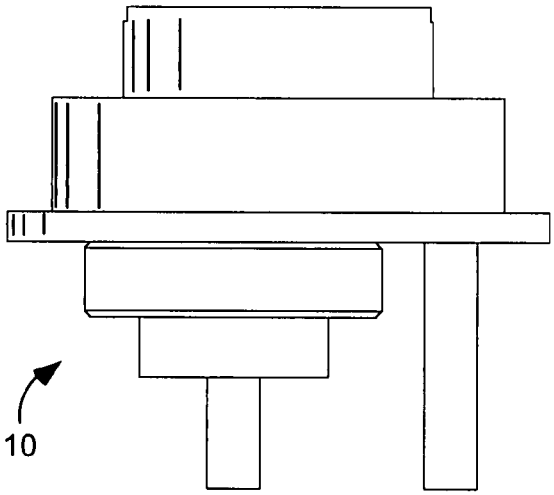
FIG. 1*d* is a front view of the cathode header optic of FIG. 1*a;*
Figure 2B:
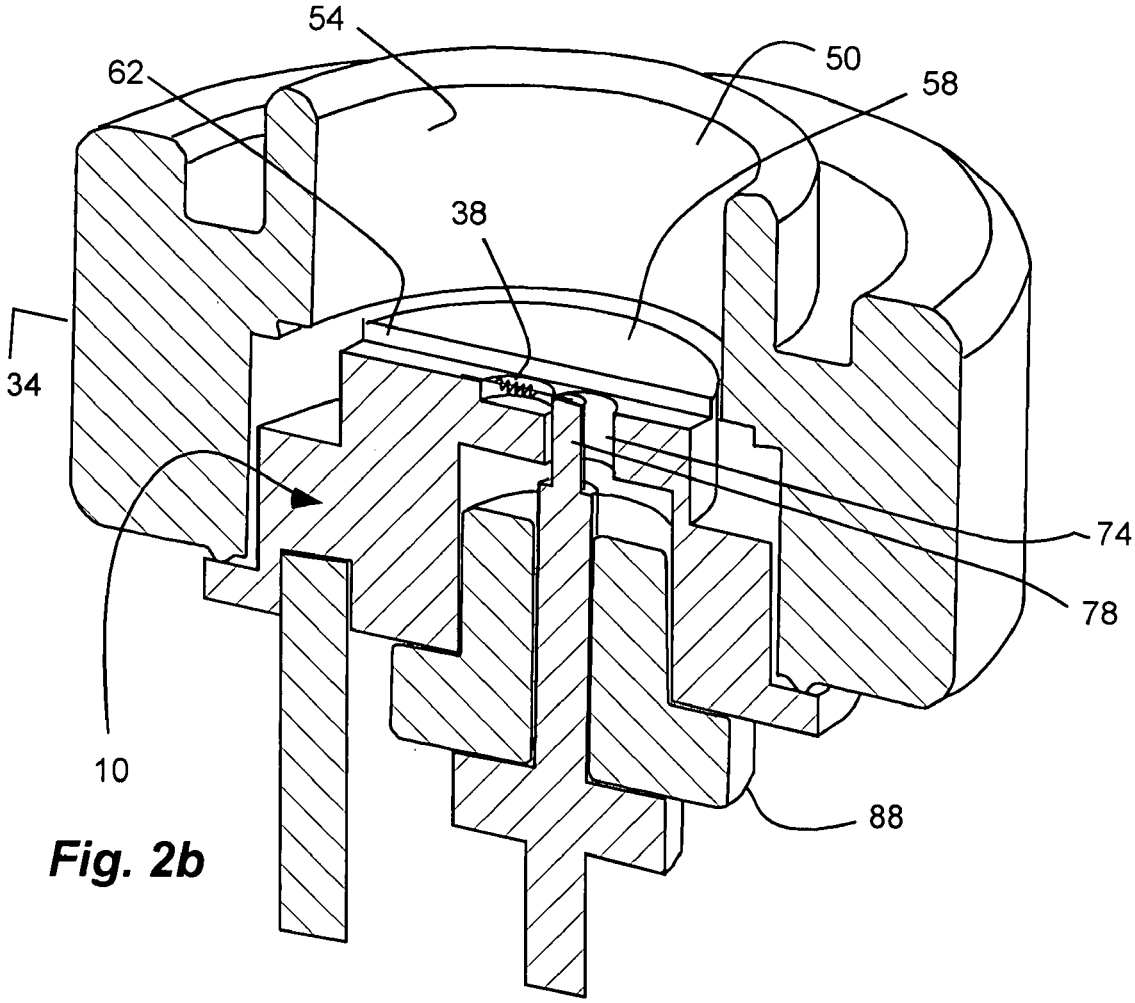
FIG. 2*b* is a perspective cross-sectional view of the cathode header optic of FIG. 1*a* shown with a cathode ring or secondary cathode optic.
Figure 1E:
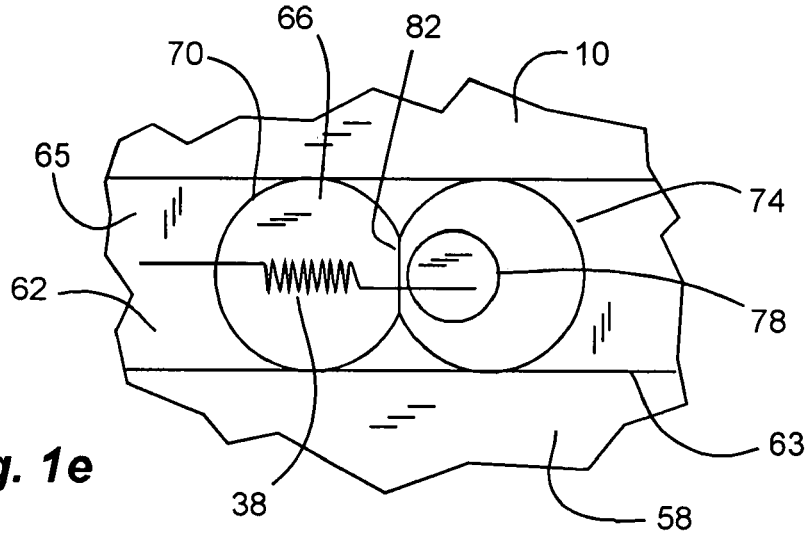
FIG. 1*e* is a partial top view of the cathode header optic of FIG. 1*a;*
Figure 1F:
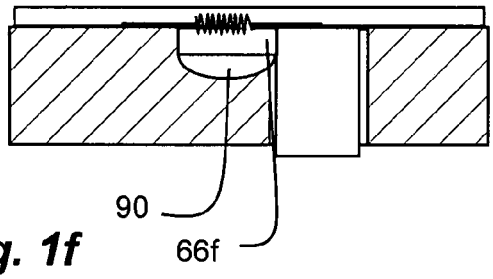
FIG. 1*f* is a cross-sectional side view of another cathode header optic in accordance with another embodiment of the present invention.
Figure 1G:
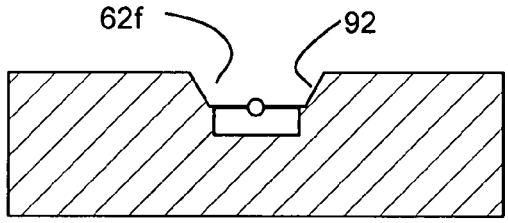
FIG. 1*g* is a cross-sectional side view of another cathode header optic in accordance with another embodiment of the present invention.
Figure 1H:
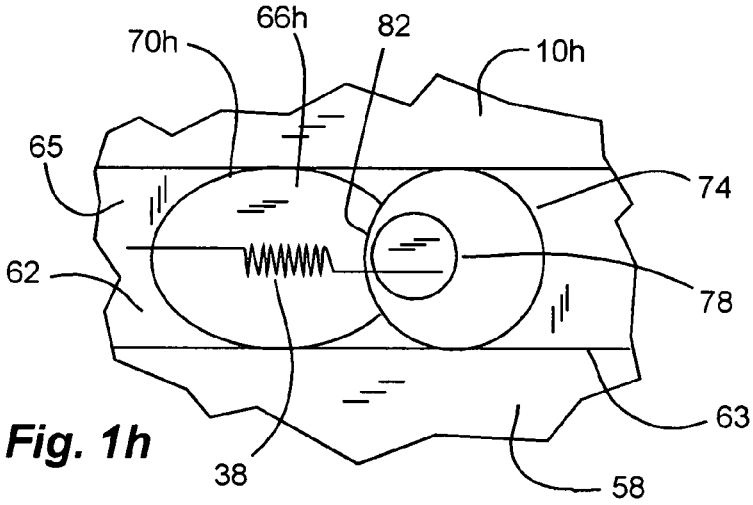
FIG. 1*h* is a partial top view of another cathode header optic and secondary cathode optic in accordance with another embodiment of the present invention.

The geometry of the cathode header optic can be configured to further shape the electric field and electron beam. As described above, the cup recess 66 is cylindrical with a flat bottom. As shown in FIG. 1*f*, the cup recess 66*f* can have a concave bottom 90. In addition, the trench 62*g* can have inclined side walls 92 that are oriented at an obtuse angle with respect to the bottom wall of the trench, as shown in FIG. 1*g*. In addition, the cup recess 66*h* or opening 70*h* can be elliptical or oval, as shown in FIG. 1*h*.

Figure 5A:
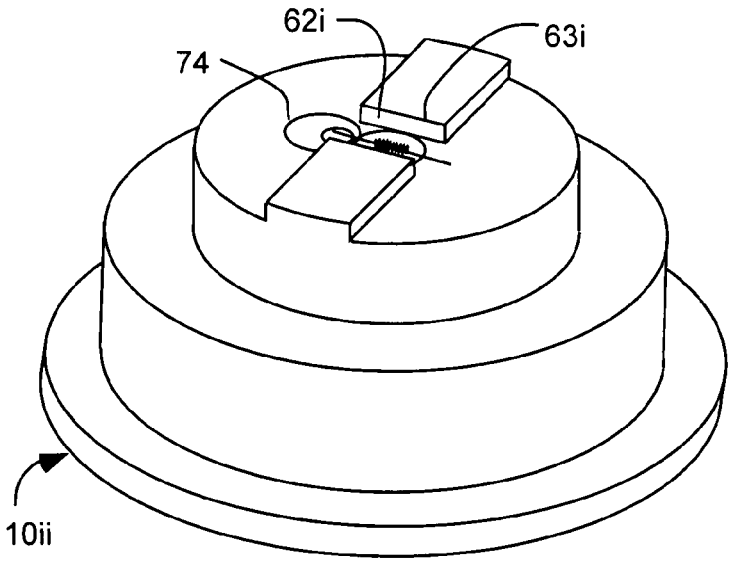
FIG. 5*a* is a perspective view of another cathode header optic in accordance with another embodiment of the present invention.
Figure 5B:
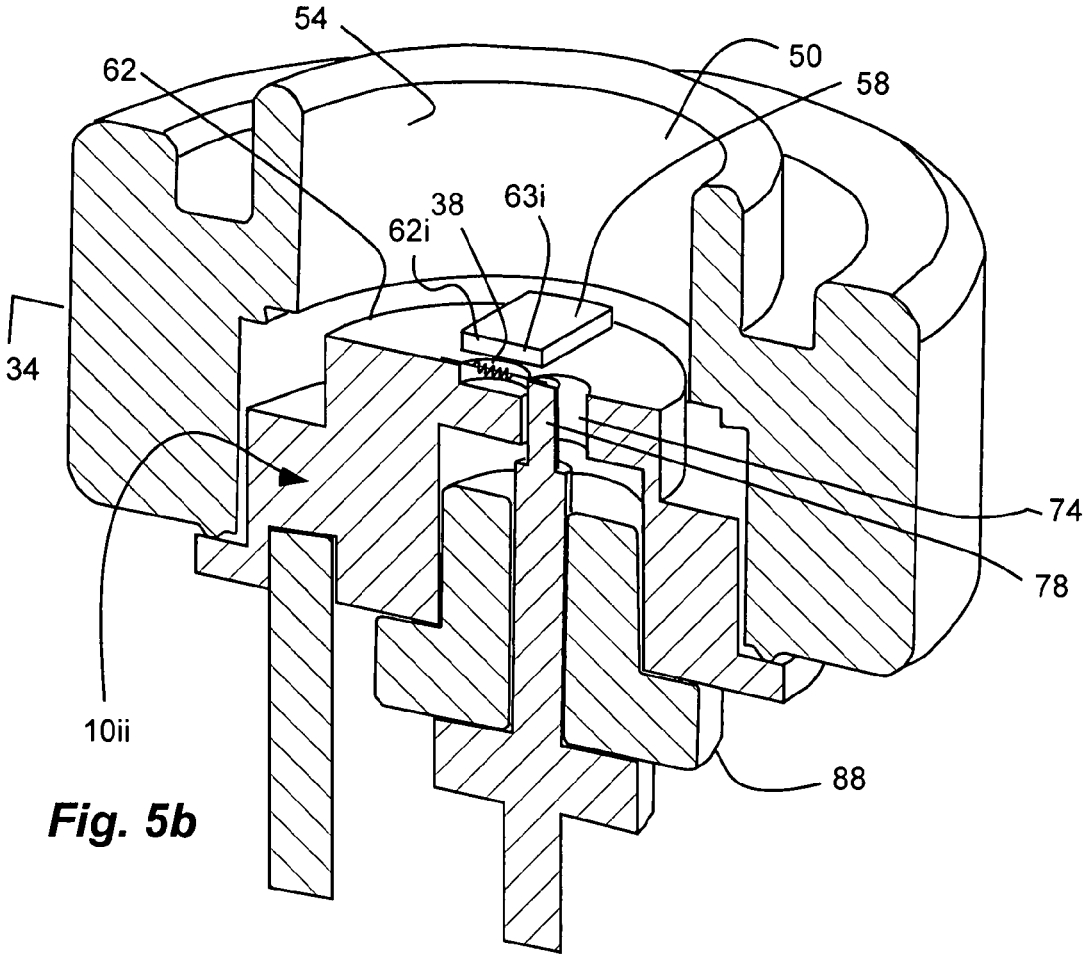
FIG. 5*b* is a perspective cross-sectional view of the cathode header optic of FIG. 5*a* shown with a cathode ring or secondary cathode optic.

Referring to FIGS. 5*a* and 5*b*, the cathode header optic 10*i* can have a trench 62*i* that does not span the well. The wall 63*i* of the trench can extend adjacent the cup recess. In addition, the lead bore 74 can be formed outside the trench, as opposed to inside the trench as in FIG. 1*b*. The long dimension or diameter of the cup recess is still less than the long dimension of the trench. It is believed that such a configuration can simplify manufacture by facilitating insertion of spot welding tools to spot weld the filament to the lead pin.

Various aspects of x-ray tubes are shown in U.S. Pat. No. 6,661,876; Ser. Nos. 11/395,531; 11/540,133 which are herein incorporated by reference.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A cathode header optic device for an x-ray tube, the device comprising:

an elongate trench with opposite trench walls and a bottom wall;

a cup recess formed in the trench and with an opening thereto formed in the bottom wall of the trench, and having a bounded perimeter including a bottom; and a cathode element disposed in the trench at the opening of the cup recess, the cathode element capable of heating and releasing electrons.

2. A device in accordance with claim 1, wherein the trench is substantially rectangular and the cup recess is substantially cylindrical.

3. A device in accordance with claim 1, further comprising:

a lead bore adjacent the cup recess; and a lead pin extending through the lead bore and electrically coupled to the cathode element.

4. A device in accordance with claim 3, wherein the cup recess and the lead bore each have an outer perimeter substantially on the same plane, and wherein the cup recess and lead bore overlap forming a passage; and wherein the lead pin is disposed adjacent the passage and substantially spans the passage.

5. A device in accordance with claim 3, wherein an end of the cathode element is electrically connected directly to the header optic.

6. A device in accordance with claim 1, wherein the cathode element is disposed between a bottom wall of the cup recess and a top of the trench.

7. A device in accordance with claim 1, wherein the cathode has a diameter less than 1 inch; and wherein the trench and the cup recess form an electron optic and shape an electric field and an electron beam with a spot size less than the cathode element.

8. A device in accordance with claim 1, wherein the trench has inclined side walls.

9. A device in accordance with claim 1, wherein the cup recess includes a concave bottom.

10. A device in accordance with claim 1, further comprising:

a cathode ring disposed in front of the cup recess and defining a secondary cathode optic, the cathode ring having a bore extending to the trench.

11. A device in accordance with claim 1, wherein a long diameter of the cup recess is less than a long dimension of the trench.

12. A device in accordance with claim 1, wherein a long diameter of the cup recess is greater than a long dimension of a coil portion of the cathode element.

13. A device in accordance with claim 1, wherein a long diameter of the cup recess is less than a long dimension of the cathode element.

14. A device in accordance with claim 1, further comprising:

a lead bore formed outside of the trench; and a lead pin extending through the lead bore and electrically coupled to the cathode element.

15. An x-ray tube device, comprising:

a) an evacuated dielectric tube;

b) an anode, disposed at an end of the tube, including a material configured to produce x-rays in response to impact of electrons;

c) a cathode, disposed at an opposite end of the tube opposing the anode, including a cathode element configured to produce electrons accelerated towards the anode in response to an electric field between the anode and the cathode; and d) the cathode including a cathode header optic comprising:

i) an elongate trench with opposite trench walls and a bottom wall;

ii) a cup recess formed in the trench and with an opening thereto formed in the bottom wall of the trench, and having a bounded perimeter including a bottom; and iii) the cathode element disposed in the trench at the opening of the cup recess.

16. A device in accordance with claim 15, wherein the trench is substantially rectangular and the cup recess is substantially cylindrical.

17. A device in accordance with claim 15, further comprising:

a lead bore adjacent the cup recess; and a lead pin extending through the lead bore and electrically coupled to the cathode element.

18. A device in accordance with claim 17, wherein the cup recess and the lead bore each have an outer perimeter substantially on the same plane, and wherein the cup recess and lead bore overlap forming a passage; and wherein the lead pin is disposed adjacent the passage and substantially spans the passage.

19. A device in accordance with claim 15, wherein the cathode element is disposed between a bottom wall of the cup recess and a top of the trench.

20. A device in accordance with claim 15, wherein the tube has a length less than 3 inches and a diameter less than 1 inch; wherein a weight of the tube, the cathode, the anode, and associated high-voltage insulation and radiation shielding is less than approximately 1 pound; and wherein the trench and the cup recess form an electron optic and shape an electric field and an electron beam with a spot size less than the cathode element.

21. A device in accordance with claim 15, wherein the trench has inclined side walls.

22. A device in accordance with claim 15, wherein the cup recess includes a concave bottom.

23. A device in accordance with claim 15, further comprising:

a cathode ring disposed between the cathode header optic and the tube and defining a secondary cathode optic, the cathode ring having a bore extending to the trench.

24. An x-ray tube device, comprising:

a) an evacuated dielectric tube;

b) an anode, disposed at an end of the tube, including a material configured to produce x-rays in response to impact of electrons;

c) a cathode, disposed at an opposite end of the tube opposing the anode, including a cathode element configured to produce electrons accelerated towards the anode in response to an electric field between the anode and the cathode; and d) the cathode including a header optic comprising:

i) an elongate trench with opposite trench walls and a bottom wall;

ii) a cup recess formed in the trench and with an opening thereto formed in the bottom wall of the trench, and having a bounded perimeter including a bottom;

iii) the cathode element disposed in the trench at the opening of the cup recess;

iv) a lead bore adjacent the cup recess; and v) a lead pin extending through the lead bore and electrically coupled to the cathode element.

25. A device in accordance with claim 24, wherein the cup recess and the lead bore each have an outer perimeter substantially on the same plane, and wherein the cup recess and lead bore overlap forming a passage; and wherein the lead pin is disposed adjacent the passage and substantially spans the passage.

26. A device in accordance with claim 24, wherein the trench is substantially rectangular; and wherein the cup recess is substantially circular.

27. An x-ray tube device, comprising:

a) an evacuated dielectric tube;

b) an anode, disposed at an end of the tube, including a material configured to produce x-rays in response to impact of electrons;

c) a cathode, disposed at an opposite end of the tube opposing the anode;

d) a cathode element configured to produce electrons accelerated towards the anode in response to an electric field between the anode and the cathode;

e) the cathode including a header comprising:

i) a single lead bore extending through the header; and ii) a single lead pin extending through the lead bore and electrically coupled to an end of the cathode element, another end of the cathode element being directly electrically coupled to the header.

28. An x-ray tube device, comprising:

a) an evacuated dielectric tube;

b) an anode, disposed at an end of the tube, including a material configured to produce x-rays in response to impact of electrons;

c) a cathode, disposed at an opposite end of the tube opposing the anode, including a cathode element configured to produce electrons accelerated towards the anode in response to an electric field between the anode and the cathode;

d) the cathode including a cathode header optic comprising:

i) an elongate trench with opposite trench walls and a bottom wall;

ii) a cup recess formed in the trench and with an opening thereto formed in the bottom wall of the trench, and having a bounded perimeter including a bottom; and iii) the cathode element disposed in the trench at the opening of the cup recess; and e) the cathode further including a secondary cathode optic comprising:

i) a cathode ring disposed between the cathode header optic and the tube and having a perimeter wall defining a well with the trench disposed at a bottom of the well.

* * * * *